US006038837A

United States Patent [19]

Odenthal

[11] Patent Number: 6,038,837

[45] Date of Patent: Mar. 21, 2000

[54] METHOD OF CLOSING AND SEALING CARDBOARD BOXES

[75] Inventor: Heinz F. Odenthal, Zülpich, Germany

[73] Assignee: SIG Pack Systems AG, Beringen, Switzerland

[21] Appl. No.: 09/033,639

[22] Filed: Mar. 3, 1998

[30] Foreign Application Priority Data

Mar. 7, 1997 [DE] Germany ..... 197 09 361

[51] Int. Cl.[7] ..... B65B 7/16

[52] U.S. Cl. ..... 53/484; 53/491; 53/383.1

[58] Field of Search ..... 53/491, 484, 382.2, 53/382.3, 383.1, 387.2; 493/128, 131, 141, 150, 151

[56] References Cited

U.S. PATENT DOCUMENTS

| | | | |
|---|---|---|---|
| 4,460,349 | 7/1984 | Charron | 493/131 |
| 4,519,181 | 5/1985 | Sherman et al. | 493/151 |
| 4,578,054 | 3/1986 | Herrin | 493/131 |
| 4,976,672 | 12/1990 | Harrison et al. | 493/131 |
| 5,385,526 | 1/1995 | Sigrist et al. | 493/151 |

FOREIGN PATENT DOCUMENTS

| | | | |
|---|---|---|---|
| 0 551 613 | 7/1993 | Germany . | |
| 1407782 | 9/1975 | United Kingdom | 53/382.3 |

*Primary Examiner*—Eugene L. Kim
*Attorney, Agent, or Firm*—Herbert Dubno; Andrew Wilford

[57] ABSTRACT

Boxes each having a plurality of relatively short side panels having upper edges three of which are free edges and one of which is connected to a cover panel itself having free edges and at least one flap projecting from one of the free edges are closed by first inserting the boxes one after the other into respective pockets formed between crosswise partitions on an endless conveyor belt spanned over a plurality of rollers. Each cover is folded onto the respective box by engagement with the partitions of the respective pocket on insertion of the respective box into the respective pocket. Then adhesive is applied to the flaps while the boxes are in the pockets and the adhesive-coated flaps are pressed against the boxes while the boxes are in the pockets.

9 Claims, 5 Drawing Sheets

METHOD OF CLOSING AND SEALING CARDBOARD BOXES

FIELD OF THE INVENTION

The present invention relates to a method of closing and sealing cardboard boxes. More particularly this invention concerns such a method used to close and seal boxes coming at high speed off a production line, normally just after being filled.

BACKGROUND OF THE INVENTION

Figure 1:
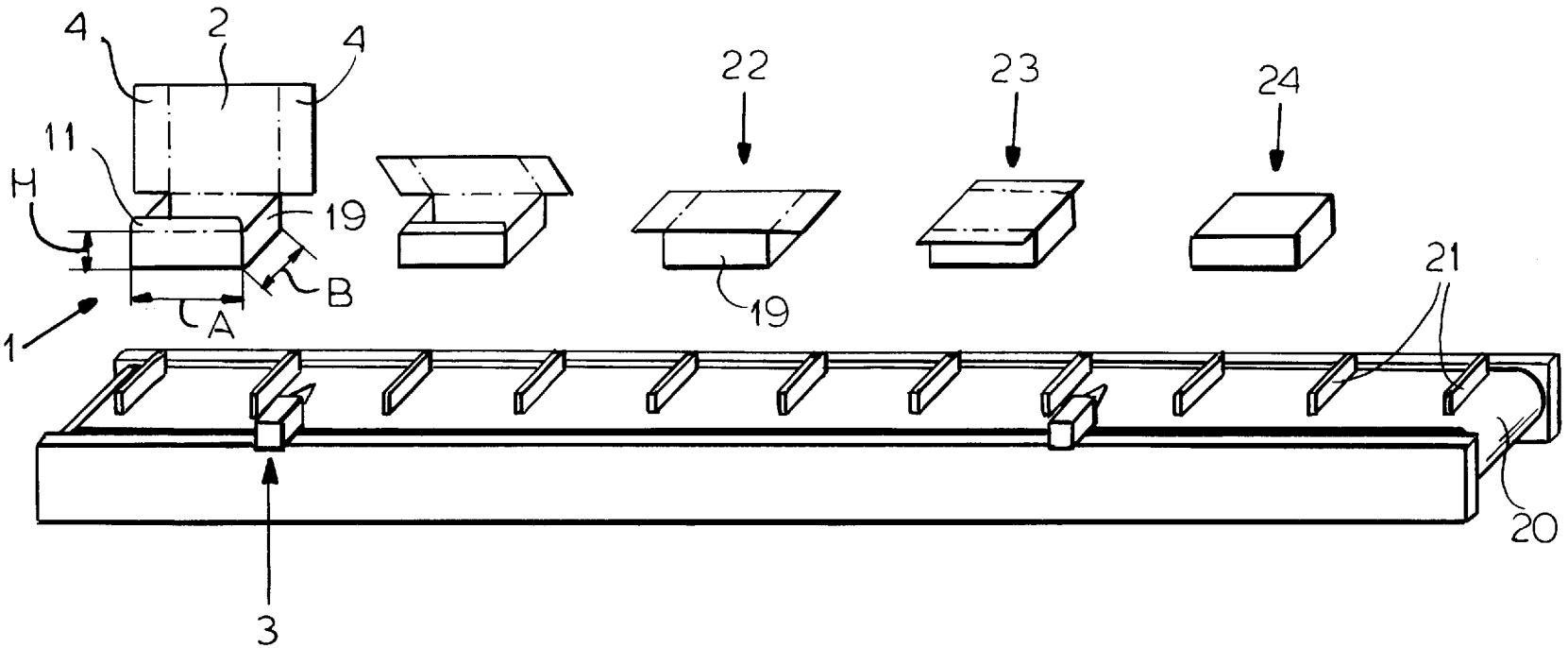
FIG.1 PRIOR ART
FIG. 1 is a schematic view illustrating the prior-art box-sealing and -closing method.
Figure 4A:
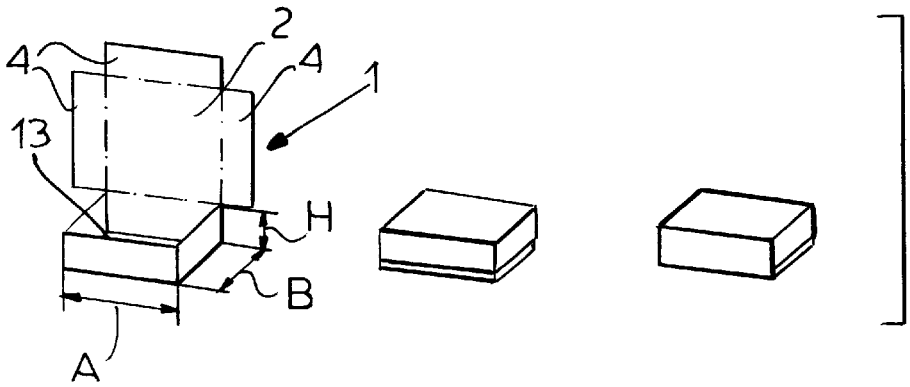
FIGS. 4*a* through 4*d* are detail views of various boxes before and after closing and sealing.

In a standard box-closing and -sealing operation the boxes 1 as shown in FIG. 1 each have a plurality of side panels 19 projecting upward from a floor panel 13 (FIG. 4*a* only). A top panel 2 has a rear edge hinged to the upper edge of one of the side panels 19 and the upper edges of the side panels 19 are formed with flaps 11 and/or the other edges of the cover 2 are formed with flaps 4.

Once each box 1 has been filled it is typically loaded onto a horizontal upper stretch of a conveyor belt 20 having a succession of crosswise pocket-defining bars 21, with the bottom panel of each box 1 resting horizontal and flat on the surface of the belt 20 in the respective pocket. The boxes 1 are moved downstream through a succession of stations 22, 23, and 24 at which first the cover is folded down, then the flaps are coated with adhesive, then the adhesive-coated flaps are pressed against the respective surfaces of the box 1 by tools indicated schematically at 3 to form a sealed package.

Since the length A and width B of the boxes 1 are normally much greater than its height H, it is necessary that the pockets of the conveyor 20 have a length at least equal to the width A or length B of the boxes 1 being worked on. In addition the three stations 22, 23, and 24 for closing, applying adhesive, and pressing must be one after the other, necessitating a relatively long path for the conveyor belt. The result is a piece of equipment some 4 m to 5 m long that takes up an excessive amount of space in the production or packaging operation.

Object of the Invention

It is therefore an object of the present invention to provide an improved method of closing and sealing boxes.

Another object is the provision of such an improved method of closing and sealing boxes which overcomes the above-given disadvantages, that is which is relatively simple and takes up little space.

Summary of the Invention

Boxes each having a plurality of relatively short side panels having upper edges three of which are free edges and one of which is connected to a cover panel itself having free edges and at least one flap projecting from one of the free edges are closed according to the invention by first inserting the boxes one after the other into respective pockets formed between crosswise partitions on an endless conveyor element spanned over a plurality of rollers. Each cover is folded onto the respective box by engagement with the partitions of the respective pocket on insertion of the respective box into the respective pocket. Then adhesive is applied to the flaps while the boxes are in the pockets and the adhesive-coated flaps are pressed against the boxes while the boxes are in the pockets.

Thus with this system the step of closing the cover panel is taken care of automatically as the box is inserted into its pocket and the entire process takes place on a continuously moving belt. This prevents their contents from falling out or shifting. Thereafter the boxes are handled standing on their edges so that they can be much more closely juxtaposed on the conveyor.

According to the invention the boxes are loaded onto the belt with the one side panel leading so in effect the boxes are sitting on their edges or sides on the conveyor belt. As a result the conveyor can move much more slowly than in prior-art systems while the apparatus still takes up much less floor space than the prior-art machines. This slower movement makes it easier for the glue-applying and pressing tools to work accurately and generally prevents damage to the boxes.

According to the invention the partitions extend perpendicular to the belt and are spaced along the belt at a spacing equal to slightly more than a height of the side walls. The boxes are inserted into the respective pockets where the belt is passing around one of the rollers and the partitions diverge. Thus as the partitions return to parallel positions, as the belt straightens out when it leaves this one roller, the partitions automatically further press the covers down on the boxes.

The adhesive in accordance with the invention is applied to the flaps and the flaps are pressed against the boxes while the respective pockets are at the one roller. Alternately the adhesive is applied and the flaps are pressed against the box in a station through which the belt runs straight.

Normally according to the invention the belt is displaced continuously and the adhesive is applied and the flaps are folded by respective tools that are displaced synchronously with the belt. It is also possible to move the belt in steps as described in commonly owned European patent application 0,551,613.

The box in accordance with the invention has flaps on the free edges both of the cover and of the side panels. The side-panel flaps are folded in before the adhesive is applied to the flaps. Then the cover is pressed down on the free edges of the side panels prior to pressing the adhesive-coated flaps against the box.

According to the invention the boxes are pushed after pressing the flaps against the boxes crosswise out of the pockets. They can be pushed in groups out of the pockets. In one system the boxes are pushed out of the pockets by advancing a pusher bar at an acute angle to the belt at a speed having a vector parallel to the belt equal to an advance speed of the belt and engaging the pusher bar with the boxes.

To hold the boxes on the belt, it is foraminous and air is evacuated through it to suctionally hold the boxes on the belt.

Specific Description

Figure 2:
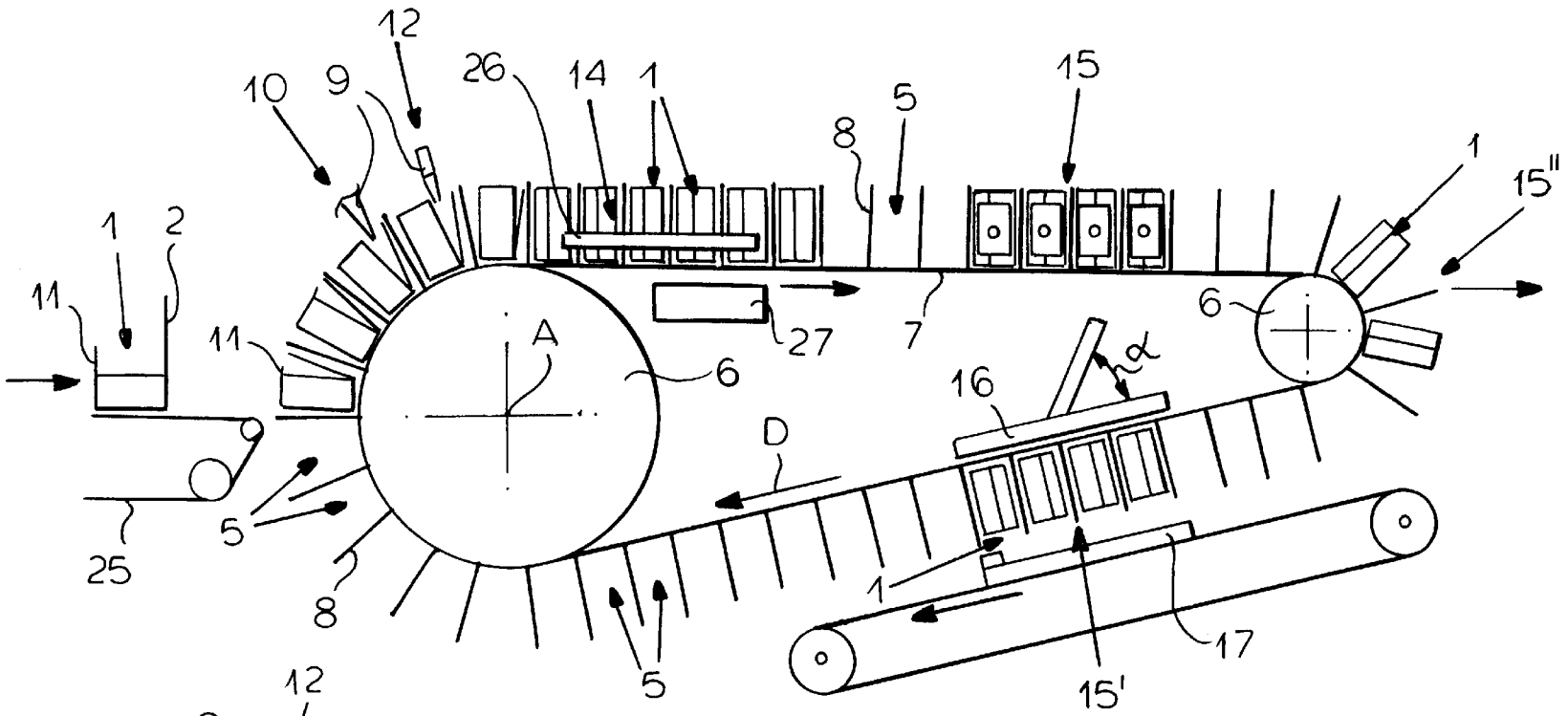
FIG. 2 is a side view of a system for carrying out the method of this invention.
Figure 2A:
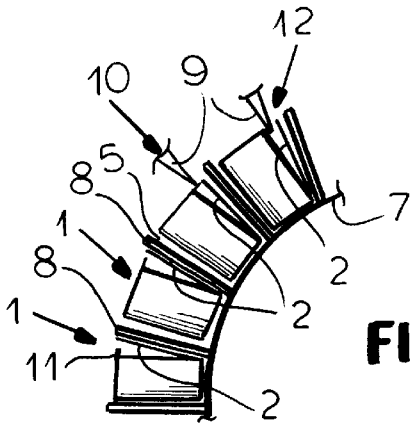
FIG. 2*a* is a large-scale view of a detail of FIG. 2.

As seen in FIGS. 2 and 2A the system of the instant invention has a conveyor belt 7 provided with crosswise partition plates 8 standing perpendicular to the belt 7 and to a direction D it moves in. The partitions 8 define a succession of pockets 5 and the belt 7 spanned over a large-diameter upstream roller 6 and a smaller-diameter downstream roller 6. As the belt 7 moves about the larger upstream roller 6 the partition plates 8 naturally assume positions extending radially of the axis A of this roller 6, that is with the partition plates 8 of each pocket 5 diverging from each other with their outer ends more widely spaced than their inner ends.

An input conveyor 25 feeds the boxes 1 one after another to the belt 7 at a closing station 10 located right at the upstream roller 6 where the partitions 8 are spread. The belt 7 is foraminous and juxtaposed with one or more suction chambers 27 to hold the boxes 1 in place on the belt 7. The boxes 1 are fed by the conveyor 25 to the station 10 radially of the axis A with the side 19 of the box 1 from which the top panel 2 extends first so that this side panel 19 engages the belt 7. Pushing the box 1 in between the partitions 8 partially closes the box 1. Immediately downstream of the station 10 are tools 9 that apply glue to the flaps 4 and 11 in a station 12 still located on the periphery of the roller 6. Subsequently the boxes pass to a station 14 where the glue-coated flaps 4 and 11 are pressed tightly against the side walls 19 of the box 1 by tools 14.

As the conveyor belt 7 straightens out on leaving the roller 6 the partitions 8, which are spaced apart in the direction D by a distance equal to slightly more than the height H of the side panels 19, assume positions parallel to each other and perpendicular to the belt 7 so that they automatically completely close the boxes 1 and tools 26 can press the flaps 11 in and complete the closing and sealing operations. The tools 9 and 26 are moved synchronously with the continuously advancing belt 7.

FIG. 2 further shows a device 15 for pushing the finished sealed and closed boxes 1 out of the pockets 5 horizontally, here parallel to the plane of the belt stretch they are standing on, as well as a second device 15' which pushes them out perpendicular to the belt. This device 15' comprises a bar 16 extending parallel to the belt 7 and advanced relative thereto at an acute angle $\alpha$ at a high speed whose vector parallel to the belt 7 is equal to the belt speed. The push-out device 15' can deposit the closed boxes 1 into a tray 17 that is moved by a belt 28 synchronously with the belt 7.

Figure 3:
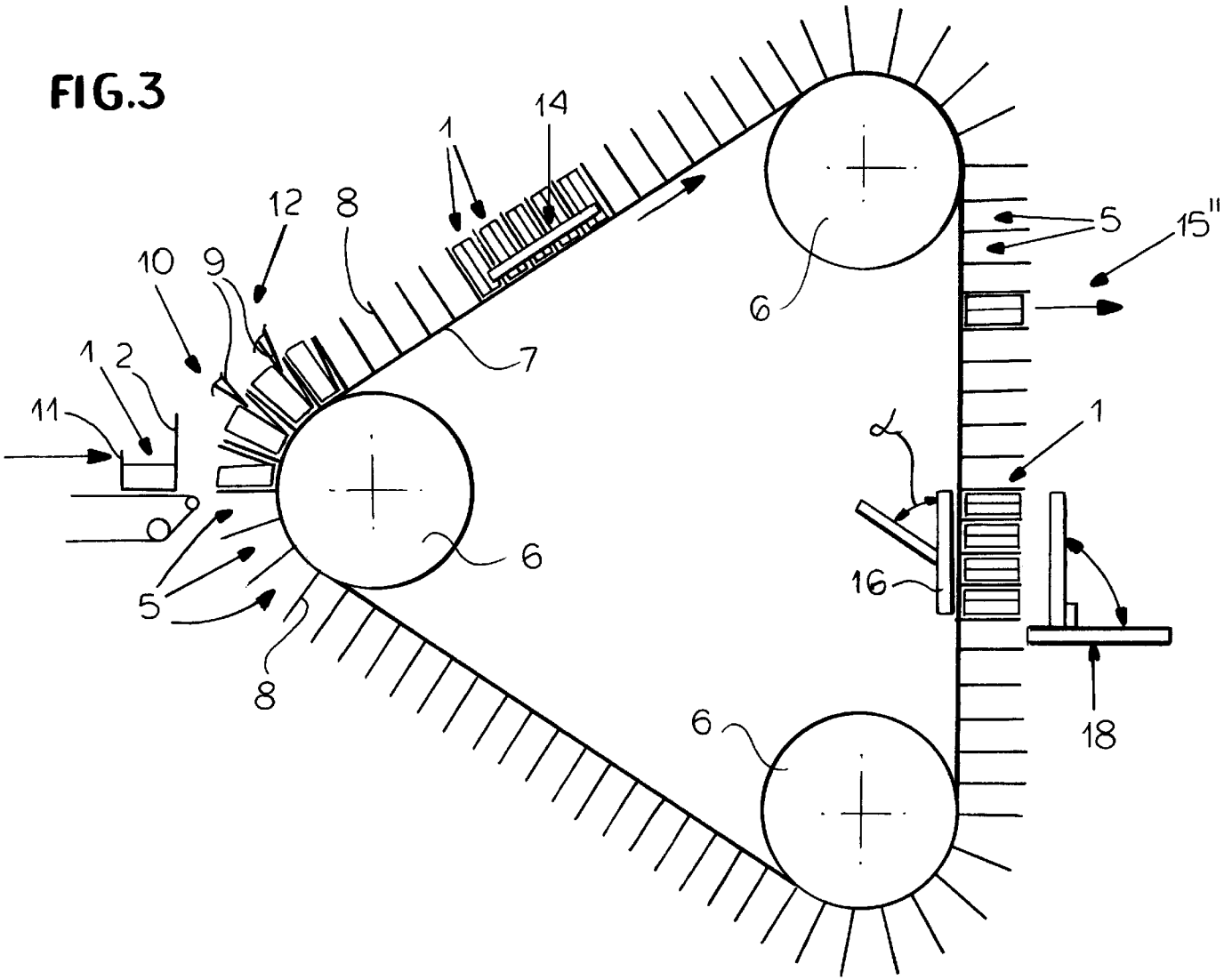
FIG. 3 is a side view of another system for carrying out the method according to the invention.

Alternately as shown in FIG. 3 the boxes 1 can be pushed out by a bar 16 and then gripped by a tong arrangement 18 for transfer to a shipping carton.

Figure 4B:
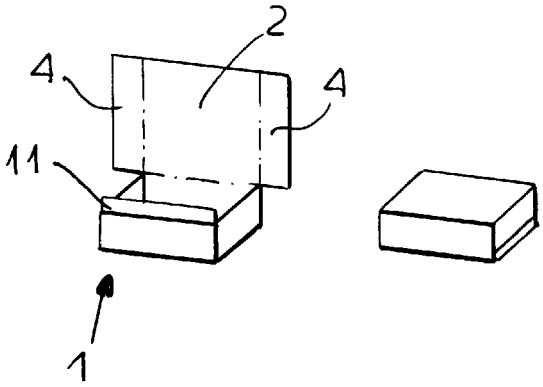
Figure 4C:
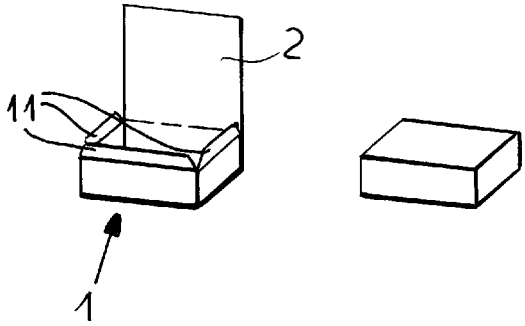
Figure 4D:
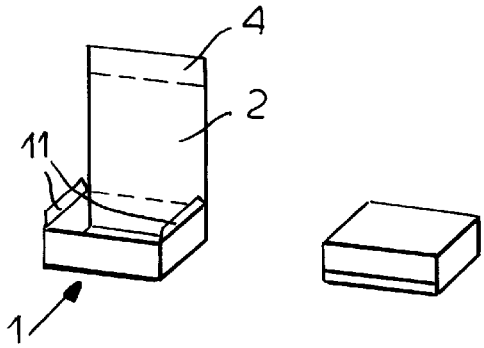

FIG. 4*a* shows a box 1 with flaps 4 on all three free edges of its top panel 2 both in unfolded condition and in closed condition from front and back. In FIG. 4*b* the box 1, which is of the type shown in FIGS. 2 and 3, has a flap 11 on the free edge of its front side panel and two flaps 4 on the side free edges of the top panel 2. FIG. 4*c* has a box 1 with flaps 11 on the upper free edges of three side panels and no flaps on the free edges of the cover panel 2. FIG. 4*d* shows an arrangement with two flaps 11 on free edges of two of the side panels and one flap 4 on one of the free edges of the cover panel 2. The flaps 4 and 11 can be applied to the outside of the box 1 or tucked inside it.

Figure 5:
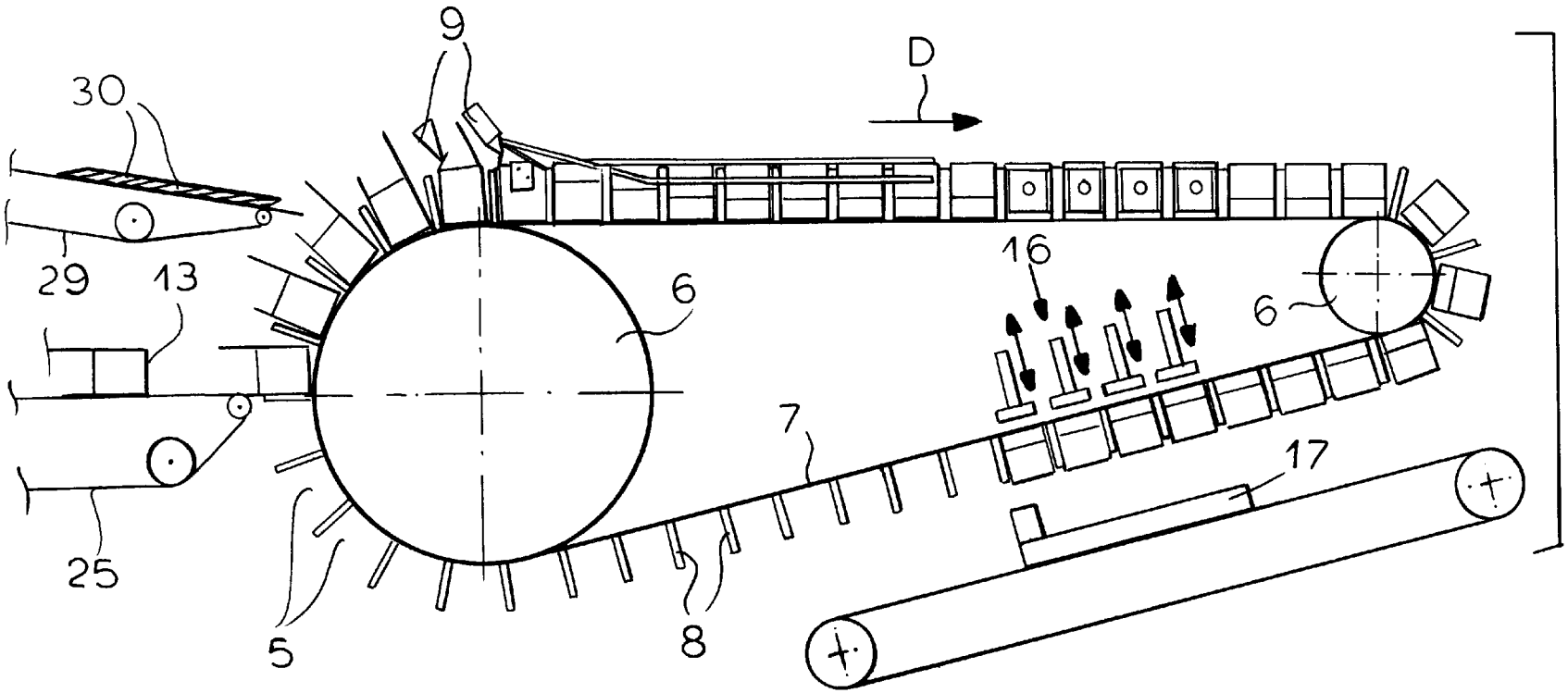
FIG. 5 is a schematic side view of another system in accordance with the invention.

FIG. 5 shows another arrangement, using the same reference numerals as described above for functionally identical structure. Here, however, the boxes 1 are loaded into the pockets 5 with their floors 13 first. A conveyor 29 serves to load in flat objects 30 that fill the boxes 1.

I claim:

1. A method of closing boxes each having a floor and a plurality of relatively short side panels extending crosswise from the floor and having upper edges three of which are free edges and a first one of which is connected to a cover panel itself having free edges, and at least one flap projecting from a second one of the free edges, the method comprising the steps of:

continuously rotating a pair of rollers over which an endless conveyor belt is spanned to move the belt continuously;

inserting the boxes one after the other into respective pockets formed between crosswise partitions of the moving belt spanned over the rollers with the side panel having the first free edge leading and engaging the belt;

applying adhesive to the flaps while the boxes are in the pockets of the moving belt;

folding each cover onto the respective box by engagement with the partitions of the respective pocket on insertion of the respective box into the respective pocket of the moving belt;

pressing the adhesive-coated flaps against the boxes while the boxes are in the pockets of the moving belt; and pushing groups of the boxes after pressing the flaps against the boxes crosswise out of the pockets of the moving belt.

2. The box-closing method defined in claim 1 wherein the partitions extend perpendicular to the belt and are spaced along the belt at a spacing equal to slightly more than a height of the side walls, the boxes being inserted into the respective pockets where the belt is passing around one of the rollers and the partitions diverge, the covers being folded onto the respective boxes by engagement of the covers with the partitions.

3. The box-closing method defined in claim 2 wherein the adhesive is applied to the flaps and the flaps are pressed against the boxes while the respective pockets are at the one roller.

4. The box-closing method defined in claim 2 wherein the adhesive is applied and the flaps are pressed against the box in a station through which the belt runs straight.

5. The box-closing method defined in claim 1 wherein the adhesive is applied and the flaps are folded by respective tools that are displaced synchronously with the belt.

6. The box-closing method defined in claim 1 wherein the box has flaps on the free edges both of the cover and of the side panels, the side-panel flaps being folded in before the adhesive is applied to the flaps, the method further comprising the step of pressing the cover down on the free edges of the side panels prior to pressing the adhesive-coated flaps against the box.

7. The box-closing method defined in claim 1 wherein the boxes are pushed out of the pockets by advancing a pusher bar at an acute angle to the belt at a speed having a vector parallel to the belt equal to an advance speed of the belt and engaging the pusher bar with the boxes.

8. The box-closing method defined in claim 1 wherein the belt is foraminous, the method further comprising the step of evacuating air through the belt and thereby suctionally holding the boxes on the belt.

9. A method of closing boxes each having a plurality of relatively short side panels having upper edges three of which are free edges and one of which is connected to a cover panel itself having free edges, and at least one flap projecting from one of the free edges, the method comprising the steps of:

inserting the boxes one after the other into respective pockets formed between crosswise partitions on an endless conveyor belt spanned over a plurality of rollers with the one side panel leading and engaging the belt;

folding each cover onto the respective box by engagement with the partitions of the respective pocket on insertion of the respective box into the respective pocket;

applying adhesive to the flaps while the boxes are in the pockets; and pressing the adhesive-coated flaps against the boxes while the boxes are in the pockets.

* * * * *